US009341970B2

(12) United States Patent
Yoshiba et al.

(10) Patent No.: US 9,341,970 B2
(45) **Date of Patent: *May 17, 2016**

(54) TONER

(71) Applicant: CANON KABUSHIKI KAISHA, Tokyo (JP)

(72) Inventors: Daisuke Yoshiba, Suntou-gun (JP); Katsuhisa Yamazaki, Numazu (JP); Koji Nishikawa, Susono (JP); Shotaro Nomura, Suntou-gun (JP); Hiroki Akiyama, Toride (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/446,290

(22) Filed: Jul. 29, 2014

(65) Prior Publication Data

US 2015/0037729 A1 Feb. 5, 2015

(30) Foreign Application Priority Data

Aug. 1, 2013 (JP) ..... 2013-160757

(51) Int. Cl.
*G03G 9/087* (2006.01)
*G03G 9/08* (2006.01)

(52) U.S. Cl.
CPC ..... *G03G 9/08755* (2013.01); *G03G 9/0808* (2013.01); *G03G 9/0821* (2013.01); *G03G 9/08786* (2013.01); *G03G 9/08788* (2013.01); *G03G 9/08791* (2013.01); *G03G 9/08795* (2013.01); *G03G 9/08797* (2013.01)

(58) Field of Classification Search
CPC ..... G03G 9/08755; G03G 9/08795; G03G 9/08797; G03G 9/08791; G03G 9/08788; G03G 9/0821
USPC ..... 430/109.4
See application file for complete search history.

(56) References Cited

U.S. PATENT DOCUMENTS

| | | | | |
|---|---|---|---|---|
| 5,578,409 | A | 11/1996 | Kotaki et al. | |
| 7,901,857 | B2 | 3/2011 | Nakazawa et al. | |
| 8,652,719 | B2 | 2/2014 | Uchinokura et al. | |
| 2010/0297547 | A1* | 11/2010 | Hirota et al. | 430/109.4 |
| 2012/0021350 | A1 | 1/2012 | Fukuri et al. | |
| 2015/0037728 | A1* | 2/2015 | Moribe et al. | 430/109.4 |

FOREIGN PATENT DOCUMENTS

| | | | |
|---|---|---|---|
| EP | 2 237 111 | A1 | 10/2010 |
| JP | 3015244 | B2 | 3/2000 |
| JP | 2006-293285 | A | 10/2006 |
| JP | 4858165 | B2 | 1/2012 |
| JP | 2012-234103 | A | 11/2012 |

OTHER PUBLICATIONS

U.S. Appl. No. 14/444,986, filed Jul. 28, 2014. Applicant: Katsuhisa Yamazaki, et al.
European Search Report dated Dec. 23, 2014 in European Application No. 14179240.8.

* cited by examiner

*Primary Examiner* — Janis L Dote
(74) *Attorney, Agent, or Firm* — Fitzpatrick, Cella, Harper and Scinto

(57) ABSTRACT

The toner includes a resin component containing a crystalline polyester resin and a polyester-type resin that has a long-chain monomer bonded by condensation at a terminal, the toner having, in a total heat flow measured by a temperature-modulated differential scanning calorimeter, an endothermic peak resulting from the crystalline polyester resin in a specific temperature range, and the percentage of the endothermic quantity of the endothermic peak in a reversing heat flow with respect to the endothermic quantity of the endothermic peak in the total heat flow being at least 20.0%.

10 Claims, No Drawings

TONER

BACKGROUND OF THE INVENTION

1. Field of the Invention

The present invention relates to a toner that is used in recording methods such as electrophotographic methods.

2. Description of the Related Art

Additional improvements in the low-temperature fixability of toners have been required in recent years for electrophotographic machines in order to achieve energy savings. On the other hand, electrophotographic machines are used in a very wide variety of regions, and as a consequence extended exposure to harsher use environments has become a possibility. For example, standing for about 30 days in high temperature, high humidity environments, such as 40° C. and 95% RH, can be foreseen.

Various improvements to the toner resin have been devised in order to improve the low-temperature fixability of toners. For example, styrene-acrylic resins and polyester resins are known as toner resins, but the use of polyester resins is preferred due to their excellent durability and excellent low-temperature fixability.

With regard to such polyester resins, with a view to the low-temperature fixability in particular Japanese Patent No. 3,015,244 proposes a toner that contains a polyester resin that has been at least partially modified by a compound that has a long-chain alkyl group having from 22 to 102 carbon atoms and the hydroxyl group or carboxyl group at a terminal. When this is done, a toner is obtained that exhibits an excellent hot offset resistance and excellent low-temperature fixability in a heat roller-type fixing unit; however, there is room for improvement in on-demand fixing system.

On the other hand, attention has been focused in recent years on crystalline polyester resins, for which the low-temperature fixability and storability can co-exist in good balance. When, in particular, a suitable amount of a crystalline polyester is added to a toner that uses a polyester-type resin as its major component, the polyester-type resin as major component is plasticized and the low-temperature fixability undergoes a substantial improvement.

For example, Japanese Patent Application Laid-open No. 2006-293285 provides a toner having a core/shell structure in the form of a toner that uses a crystalline polyester resin as the core material. This serves to provide a toner for which the low-temperature fixability and storability can co-exist in good balance.

A toner that contains a crystalline polyester resin and a release agent whose endothermic peak temperatures are close to one other is provided by Japanese Patent Application Laid-open No. 2012-234103. According to Japanese Patent Application Laid-open No. 2012-234103, the low-temperature fixability is excellent and control of the gloss value of the image is made possible.

A toner that contains an amorphous polyester resin and a crystalline polyester resin is provided in Japanese Patent No. 4,858,165: this toner uses as the amorphous polyester resin a resin component for which at least one selection from alkylsuccinic acids, alkenylsuccinic acids, and their anhydrides is incorporated and reacted as the acid component.

It is taught here that when this is done, the occurrence of micro non-uniformity in melting during toner melting can be suppressed by the use of an aliphatic crystalline polyester resin as the crystalline polyester resin and the co-use therewith of long-chain alkyl group- and/or alkenyl group-bearing amorphous polyester resins having different molecular weights. Even when variations occur in the amount of heat during fixing, a high-quality color image is then obtained that is free of unevenness in the image gloss value and free of fixing defects, e.g., offset, even in high image density areas.

Thus, as indicated in the preceding, a number of technologies have been introduced by which the low-temperature fixability is improved through the addition of a crystalline polyester.

However, crystalline polyester resins have a slow crystallization rate, and due to this a component that does not completely convert into the crystal is prone to be present in the toner. As a result, when such a toner is allowed to stand for 30 days in a high temperature, high humidity environment, such as 40° C. and 95% RH, the crystalline polyester resin may recrystallize and accompanying this the glass transition temperature (Tg) of the toner may increase, and there is thus a tendency for the low-temperature fixability to be susceptible to a decline in comparison to that prior to standing. This phenomenon is also referred to as the temporal stability below.

The above document, however, is silent on the temporal stability of the state of existence of the crystalline polyester resin during long-term standing in a high temperature, high humidity environment, and room for improvement remains.

SUMMARY OF THE INVENTION

The present invention provides a toner that uses a crystalline polyester resin, as noted above, wherein this toner exhibits an excellent low-temperature fixability and, through a suppression of the increase in the glass transition temperature (Tg) of the toner that is associated with recrystallization of the crystalline polyester resin, can exhibit an excellent and stable low-temperature fixability even upon long-term standing in a high temperature, high humidity environment.

The present invention relates to a toner comprising a toner particle that contains at least a resin component, the resin component containing;

a first resin as a major component, and a second resin, wherein;

the first resin is a polyester-type resin, the polyester-type resin has;

a terminal end of which an aliphatic compound has been condensed, the aliphatic compound being selected from the group consisting of:

an aliphatic monocarboxylic acid having a peak value of the number of carbon atom in the range from 25 to 102, and an aliphatic monoalcohol having a peak value of the number of carbon atom in the range from 25 to 102, and wherein:

the second resin is a crystalline polyester resin, and in a total heat flow of the toner obtained by measuring the toner with a temperature-modulated differential scanning calorimeter, the toner has an endothermic peak resulting from the crystalline polyester resin in the temperature range from at least 50.0° C. to not more than 100.0° C., and the percentage of an endothermic quantity of the endothermic peak in a reversing heat flow with respect to an endothermic quantity of the endothermic peak in the total heat flow being at least 20.0%.

The present invention can provide a toner that exhibits an excellent low-temperature fixability and that, through a suppression of the increase in the glass transition temperature (Tg) of the toner that is associated with recrystallization of the crystalline polyester resin, can exhibit an excellent and stable low-temperature fixability even upon long-term standing in a high temperature, high humidity environment.

Further features of the present invention will become apparent from the following description of exemplary embodiments.

DESCRIPTION OF THE EMBODIMENTS

The toner of the present invention has a toner particle that contains at least a resin component, the resin component containing a first resin as a major component, and a second resin, wherein the first resin is a polyester-type resin; the polyester-type resin has a terminal end of which an aliphatic compound has been condensed, the aliphatic compound being selected from the group consisting of an aliphatic monocarboxylic acid having a peak value of the number of carbon atom in the range from 25 to 102, and an aliphatic monoalcohol having a peak value of the number of carbon atom in the range from 25 to 102, and wherein; the second resin is a crystalline polyester resin, and in a total heat flow of the toner obtained by measuring the toner with a temperature-modulated differential scanning calorimeter, the toner has, an endothermic peak resulting from the crystalline polyester resin in the temperature range from at least 50.0° C. to not more than 100.0° C., and the percentage of an endothermic quantity of the endothermic peak in a reversing heat flow with respect to an endothermic quantity of the endothermic peak in the total heat flow being at least 20.0%.

<First Resin>

As noted above, the use of, for example, styrene-acrylic resins and polyester resins as the major component of the toner resin is known, but in the present invention, polyester-type resin is used as a first resin, which is the major component of the resin component for the excellent durability and low-temperature fixability this provides.

The designation that the major component in the present invention is polyester-type resin means that at least 50 mass % of the total resin component is polyester-type resin.

In the present invention, polyester-type resin means that at least 50 mass % of the constituent components of the polyester-type resin represents polyester resin or a resin constituted of polyester segments. Thus, in the present invention, at least 50 mass % of the resin component is polyester-type resin and at least 50 mass % of this polyester-type resin is polyester resin or polyester segments.

As a result of intensive investigations into the structure of polyester-type resins that exhibit an excellent low-temperature fixability, the present inventors discovered that, when this polyester-type resin has a specific crystalline segment, plasticization and melting starting from this crystalline segment are promoted and a stable low-temperature fixability is obtained.

In the present invention, the polyester-type resin having such a crystalline segment in the resin has a terminal end of which an aliphatic compound has been condensed, the aliphatic compound being selected from the group consisting of an aliphatic monocarboxylic acid having a peak value of the number of carbon atom in the range from 25 to 102 and an aliphatic monoalcohol having a peak value of the number of carbon atom in the range from 25 to 102 (these two are also collectively referred to as the "long-chain monomer" herebelow). Specifically, when a terminal carboxyl group is present on the polyester-type resin prior to bonding with the long-chain monomer, bonding is then produced by a condensation reaction with the monoalcohol. When a terminal hydroxy group is present on the polyester-type resin prior to bonding with the long-chain monomer, bonding is then produced by a condensation reaction with the monocarboxylic acid.

Here, "terminal" also includes the terminals for the branch chains if the polyester-type resin has branch chains. It is a preferred embodiment of the present invention that chain branching be present in the polyester-type resin and that condensation be effected at a branch chain terminal.

The introduction of the long-chain monomer into the polyester-type resin brings about the presence of a moiety with a partially aligned orientation in the resin and makes it possible to create a crystalline segment in the polyester-type resin.

The incorporation of the long-chain monomer in terminal position on the polyester-type resin enables facile control of the site at which the long-chain monomer is present and makes possible the uniform incorporation of the crystalline segment in the polyester-type resin. For both the aliphatic monocarboxylic acid and the aliphatic monoalcohol, the peak value of the number of carbon atom is preferably from at least 30 to not more than 80.

A peak value of the number of carbon atom in the aliphatic monocarboxylic acid and the aliphatic monoalcohol of from at least 25 to not more than 102 facilitates orientation of the long-chain monomer segment in the polyester-type resin and is thus preferred from the standpoint of bringing about the presence of a segment that melts in a prescribed temperature range.

When the peak value of the number of carbon atom is less than 25, the ability to plasticize the polyester-type resin is too great and the storage stability then declines. It is also difficult to bring about the formation of the crystalline segment in the polyester-type resin and to obtain a eutectic structure with the crystalline polyester, infra. It therefore becomes difficult to control the percentage of the endothermic quantity of the endothermic peak resulting from the crystalline polyester resin in the reversing heat flow with respect to the endothermic quantity of the endothermic peak resulting from the crystalline polyester resin in the total heat flow into the range specified for the present invention. When, on the other hand, the peak value of the number of carbon atom is greater than 102, it is difficult to obtain a plasticizing effect for the polyester-type resin and is then difficult to obtain a satisfactory low-temperature fixability.

Here, the "peak value of the number of carbon atom" is the number of carbon atoms calculated from the main peak molecular weight of the long-chain monomer.

The aliphatic monocarboxylic acid can be exemplified by saturated fatty acids such as cerotic acid (number of carbon atoms=26), heptacosanoic acid (number of carbon atoms=27), montanoic acid (number of carbon atoms=28), melissic acid (number of carbon atoms=30), lacceric acid (number of carbon atoms=32), tetracontanoic acid (number of carbon atoms=40), pentacontanoic acid (number of carbon atoms=50), hexacontanoic acid (number of carbon atoms=60), and octaheptacontanoic acid (number of carbon atoms=78), and by unsaturated fatty acids such as triacontenoic acid (number of carbon atoms=30), tetracontenoic acid (number of carbon atoms=40), pentacontenoic acid (number of carbon atoms=50), hexacontenoic acid (number of carbon atoms=60), and octaheptacontenoic acid (number of carbon atoms=78).

The aliphatic monoalcohol can be exemplified by saturated alcohols such as ceryl alcohol (number of carbon atoms=26), melissyl alcohol (number of carbon atoms=30), tetracontanol (number of carbon atoms=40), pentacontanol (number of carbon atoms=50), hexacontanol (number of carbon atoms=60), and octaheptacontanol (number of carbon atoms=78), and by unsaturated alcohols such as triacontenol (number of carbon atoms=30), tetracontenol (number of carbon atoms=40), pentacontenol (number of carbon atoms=50), hexacontenol (number of carbon atoms=60), and octaheptacontenol (number of carbon atoms=78).

The main peak molecular weight of the long-chain monomer is measured by gel permeation chromatography (GPC) as follows.

Special-grade 2,6-di-t-butyl-4-methylphenol (BHT) is added at a concentration of 0.10 mass % to gel chromatographic grade o-dichlorobenzene and is dissolved at room temperature. The sample and the BHT-containing o-dichlorobenzene are introduced into a sample vial and the sample is dissolved by heating on a hot plate set to 150° C. Once the sample has dissolved, it is introduced into the pre-heated filter unit and this is set into the main unit. The GPC sample is obtained by passage through the filter unit.

The sample solution is adjusted to give a concentration of approximately 0.15 mass %. The measurement is carried out under the following conditions using this sample solution.

instrumentation: HLC-8121GPC/HT (Tosoh Corporation)
detector: high-temperature RI
column: 2×TSKgel GMHHR-H HT (Tosoh Corporation)
temperature: 135.0° C.
solvent: gel chromatographic grade o-dichlorobenzene (with the addition of 0.10 mass % BHT)
flow rate: 1.0 mL/min
injection amount: 0.4 mL In order to calculate the main peak molecular weight of the long-chain monomer, a molecular weight calibration curve is used that is constructed using standard polystyrene resin (trade name: "TSK Standard Polystyrene F-850, F-450, F-288, F-128, F-80, F-40, F-20, F-10, F-4, F-2, F-1, A-5000, A-2500, A-1000, A-500", Tosoh Corporation).

The bonding of this long-chain monomer at a terminal of the polyester-type resin can bring about an improvement in the low-temperature fixability because the long-chain aliphatic hydrocarbon group originating with the long-chain monomer undergoes orientation within the polyester-type resin and melts in a prescribed temperature range.

The content of the long-chain aliphatic hydrocarbon group that originates with the long-chain monomer is preferably from at least 0.1 mass % to not more than 20.0 mass % in the polyester-type resin component. This content is more preferably from at least 1.0 mass % to not more than 15.0 mass % and is even more preferably from at least 2.0 mass % to not more than 10.0 mass %.

In the production of the polyester-type resin, preferably the long-chain monomer is added at the same time as the other monomer constituting the polyester-type resin and a condensation polymerization is then carried out. A thorough condensation of the long-chain monomer at the polyester-type resin terminal can be brought about by doing this. This results in a greater promotion of melting of the polyester-type resin and additional improvements in the low-temperature fixability. The simultaneous addition of the long-chain monomer is also preferred from the standpoint of eliminating long-chain monomer that is not bonded to the polyester-type resin. The long-chain monomer can be more uniformly dispersed in the toner particle by bringing about a stringent bonding of the long-chain monomer to the polyester-type resin. This results in an increase in the meltability of the polyester-type resin in the prescribed temperature range and an improvement in the low-temperature fixability of the toner. When, on the other hand, the long-chain monomer is added in the latter half of the condensation polymerization reaction of the polyester-type resin, a satisfactory introduction of the long-chain monomer into the polyester-type resin does not occur and the long-chain monomer ends up being present in a free state in the polyester-type resin. This may result in a lowering of the low-temperature fixability of the toner.

<Second Resin>

An improved low-temperature fixability is devised for the toner of the present invention through the incorporation of a crystalline polyester resin as a second resin.

The crystalline polyester resin, because it undergoes sharp melting in the temperature region at and above its melting point, can accelerate the melting speed of the toner, and in combination with this, it can substantially improve the low-temperature fixability through its plasticization of the other resin components.

In particular, the compatibilization speed is fast and an even better low-temperature fixability is obtained when the major component of the resin component in the toner particle is a polyester-type resin with a composition close to that of the crystalline polyester resin.

Here, the crystalline polyester resin refers to a polyester resin that, in a measurement carried out with a differential scanning calorimeter (DSC), has a clear and distinct endothermic peak free of stepwise changes in the endothermic quantity.

When, on the other hand, the melting point and crystalline state of the crystalline polyester resin are not strictly controlled, recrystallization can occur during standing in a high temperature, high humidity environment, the glass transition temperature (Tg) may rise accompanying this, and the low-temperature fixability may then decline in comparison to that before standing, and a detailed examination here is thus required.

In order to solve the problems cited above, the present inventors carried out investigations into the state of existence of the crystalline polyester resin and discovered that these problems are solved by the presence of the characteristic features described in the following.

Thus, a characteristic feature of the toner of the present invention is that, in the total heat flow measured thereon using a temperature-modulated differential scanning calorimeter, one or a plurality of endothermic peaks resulting from the crystalline polyester resin are present in the temperature range from at least 50.0° C. to not more than 100.0° C. and the percentage of the endothermic quantity of the endothermic peak (or peaks) in the reversing heat flow with respect to the endothermic quantity of the endothermic peak (or peaks) in the total heat flow is at least 20.0%.

A temperature-modulated differential scanning calorimeter (referred to below as temperature-modulated DSC) is used in the present invention to evaluate the crystalline state. Temperature-modulated DSC is a measurement method in which heating is carried out with the application of a periodic temperature modulation at the same time as the linear ramp. This measurement method makes it possible to measure the heat flow at the same time as variations in the heat capacity.

All of the same transition data as in standard DSC is obtained with the total heat flow provided by this measurement method.

The toner of the present invention is characterized by having one or a plurality of endothermic peaks resulting from the crystalline polyester resin in this total heat flow in the temperature range from at least 50.0° C. to not more than 100.0° C. By having the endothermic peak or peaks resulting from the crystalline polyester resin be in this temperature range, due to sharp melting in the temperature region at or above its melting point the melting speed of the toner can be accelerated and an improvement in the low-temperature fixability can be brought about.

By focusing on the components making up the endothermic peak or peaks rather than the simple presence of the endothermic peak or peaks, the present inventors also discovered an optimal crystalline state that can solve the problems identified above.

Through the additional imposition of temperature modulation at the same time as the linear ramp, temperature-modulated DSC makes possible a detection in which components that can comply with the modulation are separated into the reversing heat flow and components that cannot comply are separated into the non-reversing heat flow.

A component identified by this reversing heat flow returns to an original quality when the temperature is reduced, while a component identified by the non-reversing heat flow has a quality that does not return to the original even when the temperature is reduced. Thus, for an endothermic peak resulting from the melting of a crystalline material, a component identified by the reversing heat flow is thought to represent a rapidly crystallizing component and a component identified by the non-reversing heat flow is thought to represent a slowly crystallizing component.

Thus, when the percentage, in the endothermic peak observed in the total heat flow, of a component that separates into the non-reversing heat flow is higher than a certain amount, this indicates that the peak is constituted by a slowly crystallizing component. For a toner having such a peak, there is a high potential that a component that does not completely convert into the crystal has been incorporated during the toner production process. As a result, when such a toner is allowed to stand in a high temperature, high humidity environment (for example, 40° C., 95% RH) on a long-term basis (for example, 30 days), the component that has not completely converted into the crystal will undergo recrystallization and, accompanying this, the glass transition temperature (Tg) of the toner will increase and the low-temperature fixability will deteriorate in comparison to that prior to the holding period.

The influence on the low-temperature fixability tends to become substantial when the difference ΔTg (° C.) provided by subtracting the pre-standing Tg from the post-standing Tg reaches 5° C. or more.

In the present invention, standing conditions of 40° C./95% RH/30 days are assumed to correspond to the use environment during the summer and the conditions during transport.

When, on the other hand, the percentage, in the endothermic peak observed in the total heat flow, of a component that separates into the reversing heat flow is higher than a certain amount, this indicates that the peak is constituted by a rapidly crystallizing component. A thorough crystallization is produced during the toner production process in a toner that has such a peak. The temporal stability is excellent as a result.

As a result of intensive investigations, the present inventors discovered, for a toner that uses a crystalline polyester resin, a lower limit for the reversing heat flow component at which the low-temperature fixability and temporal stability can coexist in good balance.

Thus, the rise in toner Tg can be suppressed—even upon long-term standing in a high temperature, high humidity environment (for example, 40° C., 95% RH, 30 days)—when the toner of the present invention has, in the total heat flow measured by a temperature-modulated differential scanning calorimeter, one or a plurality of endothermic peaks resulting from the crystalline polyester resin in the temperature range of from at least 50.0° C. to not more than 100.0° C. and the percentage of the endothermic quantity of the endothermic peak (or peaks) in the reversing heat flow with respect to the endothermic quantity of the endothermic peak (or peaks) in the total heat flow (this percentage is also referred to hereebelow simply as the endothermic quantity percentage) is at least 20.0%. When in the present invention the endothermic quantity percentage is at least 20.0%, a crystallization rate is obtained in the toner production process that enables a thorough crystallization to occur. In principle, a higher endothermic quantity percentage will provide a faster crystallization rate and a better temporal stability, but the endothermic quantity percentage is preferably not more than 40.0% when the load from a production standpoint and its effects are considered.

A "Q2000" (TA Instruments) differential scanning calorimeter is used in the present invention for the temperature-modulated differential scanning calorimeter. The measurement is performed according to ASTM D 3418-82.

In specific terms, approximately 5 mg of the toner is precisely weighed out and introduced into an aluminum pan and the measurement is run under the following conditions using an empty aluminum pan as the reference.

<Measurement Conditions> measurement mode: modulation mode ramp rate: 1.0° C./minute modulation temperature amplitude: ±1.0° C./minute measurement start temperature: 20° C.

measurement completion temperature: 130° C.

<Determination of the Peak Temperature and the Endothermic Quantity ΔH1 of an Endothermic Peak in the Total Heat Flow>

After the completion of this measurement, the peak top temperature and the endothermic quantity ΔH1 (J/g) for each endothermic peak are determined in the total heat flow for all of the endothermic peaks present in the temperature range from at least 50° C. to not more than 100° C., plotting the "Heat Flow" on the vertical axis and the temperature on the horizontal axis.

<Determination of the Percentage of the Endothermic Quantity of the Endothermic Peak in the Reversing Heat Flow with Respect to the Endothermic Quantity of the Endothermic Peak in the Total Heat Flow>

For each endothermic peak for which the endothermic quantity in the total heat flow was determined as above, the endothermic quantity ΔH2 (J/g) in the reversing heat flow for each endothermic peak is determined in the same temperature range as the range in which the endothermic quantity ΔH1 in the total heat flow was determined, plotting the "Reversing Heat Flow" on the vertical axis and the temperature on the horizontal axis.

ΔH1 and ΔH2 are determined for each endothermic peak for all of the endothermic peaks present in the temperature range from at least 50° C. to not more than 100° C.

The percentage (%) of the endothermic quantity in the reversing heat flow with respect to the endothermic quantity in the total heat flow (also referred to simply as the endothermic quantity percentage (%)) for each peak is determined using the following formula.

$$\text{endothermic quantity percentage (\%)} = [\Delta H2/\Delta H1] \times 100$$

When a plurality of endothermic peaks are present here in the temperature range from at least 50° C. to not more than 100° C., it is sufficient for the present invention that the endothermic quantity percentage of any one of these plurality of endothermic peaks satisfies the range stipulated for the present invention.

The determination of whether an individual endothermic peak originates with the crystalline polyester resin is carried out by extraction with a solvent that corresponds to the peak temperature (for example, methyl ethyl ketone) and compositional analysis using pyrolysis GC-Mass and infrared spectrophotometry (IR), and an endothermic peak that contains a peak resulting from the crystalline polyester resin according to this determination is regarded as an endothermic peak resulting from the crystalline polyester resin.

In the present invention, the glass transition temperature (Tg) of the toner and the resin components is determined by the midpoint method from the previously described reversing heat flow curve. Thus, the glass transition temperature is taken to be the intersection between the reversing heat flow curve and the line (i.e., the straight line equidistant in the vertical axis direction from the straight lines that extend each baseline) for the midpoint between the baseline prior to the appearance of the specific heat change in the reversing heat flow curve and the baseline after the appearance of this specific heat change.

As a result of intensive investigations, the present inventors discovered that the endothermic quantity percentage in the reversing heat flow could be controlled to at least 20.0%, which is a characteristic feature of the present invention, through the combined use of a crystalline polyester with a polyester-type resin having at least one of an aliphatic monocarboxylic acid having a peak value of the number of carbon atom of from at least 25 to not more than 102 and an aliphatic monoalcohol having a peak value of the number of carbon atom of from at least 25 to not more than 102, condensed at a terminal end of the polyester-type resin.

The polyester-type resin is provided with a crystalline segment through the use of a polyester-type resin in which at least one of an aliphatic monocarboxylic acid having a peak value of the number of carbon atom of from at least 25 to not more than 102 and an aliphatic monoalcohol having a peak value of the number of carbon atom of from at least 25 to not more than 102, is bonded by condensation at a terminal of the polyester-type resin.

When the absolute value of the difference between the peak temperature of the endothermic peak for the crystalline segment in this polyester-type resin and the peak temperature of the endothermic peak for the crystalline polyester resin used by the present invention is 10° C. or less, the two endothermic peaks will appear as the same peak.

It is thought here that the two crystalline components undergo orientation so as to assume the crystalline structure of the main component and form a single crystalline structure, which structure is called a eutectic structure in the present invention.

Through the assumption of such a eutectic structure, the crystallization speed can be accelerated still further even for a crystalline polyester that by itself has a slow crystallization speed.

The assumption of this eutectic structure makes it even easier to establish the endothermic quantity percentage in the reversing heat flow at 20.0% or greater, which is a characteristic feature of the present invention.

The toner of the present invention has an endothermic quantity in the total heat flow of the endothermic peak resulting from the crystalline polyester resin in the temperature range of from at least 50.0° C. to not more than 100.0° C. preferably of from at least 0.10 J/g to less than 4.00 J/g and more preferably of from at least 0.30 J/g to less than 3.00 J/g.

Having this endothermic quantity in the total heat flow be in the indicated range provides an even better storage stability while maintaining the low-temperature fixability and is therefore preferred. An excellent durability is also provided for the developing performance. This endothermic quantity in the total heat flow is obtained by the previously described method for determining ΔH1. The endothermic quantity in the total heat flow of the endothermic peak resulting from the crystalline polyester resin can be adjusted into the indicated range using, for example, the amount of crystalline polyester resin addition.

There are, on the other hand, no particular limitations on the crystalline polyester resin in the present invention as long as this crystalline polyester resin has a clear and distinct endothermic peak in the total heat flow measured with a temperature-modulated differential scanning calorimeter. However, when one considers the assumption of the eutectic structure described above, the peak temperature of the endothermic peak of the crystalline polyester resin in the total heat flow measured by a temperature-modulated differential scanning calorimeter is preferably from at least 50° C. to not more than 100° C., more preferably from at least 60° C. to not more than 95° C., and even more preferably from at least 70° C. to not more than 90° C.

The alcohol component used in the starting monomer for the crystalline polyester resin can be exemplified by ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-icosanediol, but there is no limitation to the preceding.

Among the preceding, $C_{6-18}$ aliphatic diols are preferred and $C_{8-14}$ aliphatic diols are more preferred from the standpoint of the low-temperature fixability, the heat stability, and the ease of orientation in support of assuming a eutectic structure.

Viewed from the perspective of achieving an additional increase in the crystallinity of the crystalline polyester resin, the content of this aliphatic diol in the alcohol component is preferably from at least 80 mol % to not more than 100 mol %.

The alcohol component for obtaining the crystalline polyester resin may contain a polyhydric alcohol component in addition to the aliphatic diol referenced above. Examples here are aromatic diols such as alkylene oxide adducts of bisphenol A, including polyoxypropylene adducts of 2,2-bis(4-hydroxyphenyl)propane and polyoxyethylene adducts of 2,2-bis(4-hydroxyphenyl)propane, and also trihydric or higher hydric alcohols such as glycerol, pentaerythritol, and trimethylolpropane.

The carboxylic acid component used in the starting monomer for the crystalline polyester resin, on the other hand, can be exemplified by aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid, and also by their anhydrides and lower alkyl esters.

Viewed from the standpoint of increasing the crystallinity, as well as the ease of orientation in support of assuming a eutectic structure, the use of $C_{6-18}$ aliphatic dicarboxylic acid compounds among the preceding is preferred while $C_{6-10}$ aliphatic dicarboxylic acid compounds are more preferred.

The content of this aliphatic dicarboxylic acid compound in the carboxylic acid component is preferably from at least 80 mol % to not more than 100 mol %.

The carboxylic acid component for obtaining the crystalline polyester resin may contain a carboxylic acid component other than the aliphatic dicarboxylic acid compounds described above. Examples in this regard are aromatic dicarboxylic acid compounds and trivalent or higher aromatic polyvalent carboxylic acid compounds, but there is no particular limitation to these. The aromatic dicarboxylic acid compounds here also encompass aromatic dicarboxylic acid derivatives. Preferred specific examples of the aromatic dicarboxylic acid compound are aromatic dicarboxylic acids such as phthalic acid, isophthalic acid, terephthalic acid, and naphthalene-2,6-dicarboxylic acid, and the anhydrides of these acids and their alkyl (from 1 to 3 carbon atoms) esters. The alkyl group in the alkyl ester can be exemplified by the methyl group, ethyl group, propyl group, and isopropyl group. The trivalent or higher polyvalent carboxylic acid compounds can be exemplified by aromatic carboxylic acids such as 1,2,4-benzenetricarboxylic acid (trimellitic acid), 2,5,7-naphthalenetricarboxylic acid, and pyromellitic acid and by their acid anhydrides and alkyl (from 1 to 3 carbon atoms) esters.

The molar ratio between the carboxylic acid component and the alcohol component that are the starting monomers for the crystalline polyester resin (carboxylic acid component/alcohol component) is preferably from at least 0.80 to not more than 1.20.

In addition, the weight-average molecular weight (Mw) of the crystalline polyester resin is preferably from at least 7,000 to not more than 100,000 and is more preferably from at least 8,000 to not more than 45,000. This range is preferred because it enables an excellent low-temperature fixability to be obtained while suppressing the sublimability.

The weight-average molecular weight (Mw) and the number-average molecular weight (Mn) of the crystalline polyester resin are measured in the present invention using the following method.

(1) Sample Solution Preparation

The crystalline polyester resin is dissolved in chloroform to provide a sample concentration of 0.5 g/100 mL. Using a fluororesin filter with a pore size of 2 μm (FP-200 from Sumitomo Electric Industries, Ltd.), this solution is then filtered to remove the insoluble component, thereby providing the sample solution.

(2) Measurement of the Molecular Weight Distribution

The measurement instrument and analytical columns indicated below are used, and the columns are stabilized in a 40° C. thermostat while passing through chloroform as solvent at a flow rate of 1 mL/minute. The measurement is run by injecting 100 μL of the sample solution thereinto. The molecular weight of the sample is determined based on a preliminarily constructed calibration curve.

A molecular weight calibration curve constructed using polystyrene resin standards (product name: "TSK Standard Polystyrene F-850, F-450, F-288, F-128, F-80, F-40, F-20, F-10, F-4, F-2, F-1, A-5000, A-2500, A-1000, A-500" from the Tosoh Corporation) is used for the calibration curve.

instrument: HLC8120 GPC (detector: RI) (from the Tosoh Corporation)

columns: 7-column train of Shodex KF-801, 802, 803, 804, 805, 806, and 807 (from Showa Denko Kabushiki Kaisha)

The content of the crystalline polyester resin in the present invention in 100 mass parts of the resin component is preferably from at least 0.5 mass parts to not more than 10 mass parts and is more preferably from at least 1.0 mass part to not more than 7.5 mass parts. An excellent durability for the developing performance and an excellent storability are provided by control into the indicated range, which is thus preferred.

The polyester monomer used for the polyester-type resin in the present invention can be exemplified by the following compounds.

The alcohol component can be exemplified by ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives as represented by the following formula (1), and diols as represented by the following formula (2).

[Chem 1]

(1)

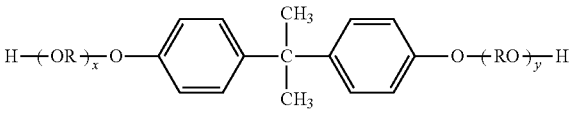

(In the formula, R represents the ethylene or propylene group; x and y are each integers equal to or greater than 1; and the average value of x+y is 2 to 10.)

[Chem 2]

(2)

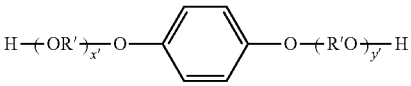

(In the formula, R' is

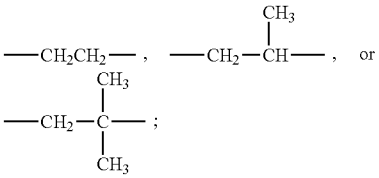

x' and y' are each integers equal to or greater than 1; and the average value of x'+y' is 2 to 10.)

The carboxylic acid component, on the other hand, can be exemplified by the following: benzenedicarboxylic acids and their anhydrides, such as phthalic acid, terephthalic acid, isophthalic acid, and phthalic anhydride; alkyl dicarboxylic acids such as succinic acid, adipic acid, sebacic acid, and azelaic acid, and their anhydrides; succinic acid that has been additionally substituted by a $C_{6-18}$ alkyl group or alkenyl group, and anhydrides thereof; and unsaturated dicarboxylic acids such as fumaric acid, maleic acid, citraconic acid, and itaconic acid, and their anhydrides.

In a preferred embodiment, the polyester-type resin used by the present invention is a polyester-type resin that contains a crosslinking structure as generated by a trivalent or higher valent polyvalent carboxylic acid or anhydride thereof and/or by a trihydric or higher hydric polyhydric alcohol. The trivalent or higher valent polyvalent carboxylic acid and anhydrides thereof can be exemplified by the following: 1,2,4-benzenetricarboxylic acid, 1,2,4-cyclohexanetricarboxylic acid, 1,2,4-naphthalenetricarboxylic acid, pyromellitic acid, and the acid anhydrides and lower alkyl esters of the preceding. The trihydric or higher hydric polyhydric alcohol can be exemplified by the following: 1,2,3-propanetriol, trimethylolpropane, hexanetriol, and pentaerythritol. Aromatic alcohols, which are also very stable to environmental changes, are particularly preferred, for example, 1,2,4-benzenetricarboxylic acid and its anhydride.

The following resins are examples of resins that can be used in the present invention in combination with the polyester-type resin:

vinylic resins, styrenic resins, styrenic copolymer resins, polyol resins, polyvinyl chloride resins, phenolic resins, natural resin-modified phenolic resins, natural resin-modified maleic acid resins, acrylic resins, methacrylic resins, polyvinyl acetates, silicone resins, polyurethane resins, polyamide resins, furan resins, epoxy resins, xylene resins, polyvinyl butyrals, terpene resins, coumarone-indene resins, and petroleum resins.

The softening point (Tm) of the polyester-type resin in the present invention is preferably from at least 70° C. to not more than 170° C. and is more preferably from at least 90° C. to not more than 150° C.

A single resin may be used by itself for the polyester-type resin, but a mixture in any proportion of two resins having different softening points, i.e., a higher softening point resin (H) and a lower softening point resin (L), may also be used. The higher softening point resin (H) preferably has a softening point of from at least 120° C. to not more than 170° C. and the lower softening point resin (L) preferably has a softening point of from at least 70° C. to less than 120° C.

This softening point is measured as described in the following. The softening point of the resin is measured according to the manual provided with the instrument, using a "Flowtester CFT-500D Flow Property Evaluation Instrument", a constant-load extrusion-type capillary rheometer from Shimadzu. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the invention. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature (Tm) by the ½ method.

The measurement sample is prepared by subjecting 1.0 g of the sample to compression molding for approximately 60 seconds at approximately 10 MPa in a 25° C. atmosphere using a tablet compression molder (NT-100H from NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm Viewed from the standpoint of the storage stability, the glass transition temperature (Tg) of the polyester-type resin in the present invention is preferably at least 45° C. Viewed from the standpoint of the low-temperature fixability, this Tg is preferably not more than 70° C. and is particularly preferably not more than 65° C.

The glass transition temperature (Tg) of the polyester-type resin is determined by the midpoint method, supra, from the reversing heat flow curve using a temperature-modulated differential scanning calorimeter.

The polyester-type resin used by the present invention is preferably a hybrid resin in which a polyester segment and a vinylic polymer segment are chemically bonded.

The use of this hybrid resin provides stable charging characteristics regardless of the environment and thus causes there to be little environment-induced change in image density and is therefore preferred.

Viewed in terms of the low-temperature fixability, the mass ratio between the polyester segment and the vinylic polymer segment (polyester segment:vinylic polymer segment) is preferably from 50:50 to 90:10 and is more preferably from 60:40 to 80:20.

When a hybrid resin is used as the polyester-type resin in the present invention, the long-chain monomer is then preferably bonded by condensation to a terminal of the polyester segment of the hybrid resin.

Here, the content of the component originating with the long-chain monomer, expressed with reference to the hybrid resin, is preferably from at least 0.1 mass % to not more than 20.0 mass %, more preferably from at least 1.0 mass % to not more than 15.0 mass %, and particularly preferably from at least 2.0 mass % to not more than 10.0 mass %.

The monomer that can be used to synthesize the polyester segment of the hybrid resin in the present invention can be exemplified by the previously described polyester monomer used for the polyester-type resin.

The vinylic monomer constituting the vinylic resin used in the resin component or the vinylic polymer segment of the hybrid resin can be exemplified by the following:

styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters, e.g., methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters, e.g., methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and derivatives of acrylic acid and methacrylic acid, e.g., acrylonitrile, methacrylonitrile, and acrylamide.

Additional examples are as follows: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the hemiesters of unsaturated dibasic acids, such as the methyl hemiester of maleic acid, the ethyl hemiester of maleic acid, the butyl hemiester of maleic acid, the methyl hemiester of citraconic acid, the ethyl hemiester of citraconic acid, the butyl hemiester of citraconic acid, the methyl hemiester of itaconic acid, the methyl hemiester of alkenylsuccinic acid, the methyl hemiester of fumaric acid, and the methyl hemiester of mesaconic acid; the esters of unsaturated dibasic acids, such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride and anhydrides between these α,β-unsaturated acids and lower fatty acids; and carboxyl group-containing monomers such as alkenylmalonic acid, alkenylglutaric acid, and alkenyladipic acid and their acid anhydrides and monoesters.

Additional examples are acrylate and methacrylate esters such as 2-hydroxyethyl acrylate, 2-hydroxyethyl methacrylate, and 2-hydroxypropyl methacrylate, and hydroxy group-bearing monomers such as 4-(1-hydroxy-1-methylbutyl)styrene and 4-(1-hydroxy-1-methylhexyl)styrene.

The vinylic resin or vinylic polymer segment in the present invention may have a crosslinked structure provided by crosslinking with a crosslinking agent that has two or more vinyl groups. The crosslinking agent used in this case can be exemplified by the following:

aromatic divinyl compounds (divinylbenzene and divinylnaphthalene), alkyl chain-linked diacrylate compounds (ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds provided by replacing the acrylate in the preceding compounds with methacrylate), diacrylate compounds in which linkage is effected by an alkyl chain that contains an ether linkage (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by replacing the acrylate in the preceding compounds with methacrylate), diacrylate compounds in which linkage is effected by a chain that has an aromatic group and an ether linkage (polyoxyethylene(2)-2,2-bis(4-hydroxyphenyl)propane diacrylate, polyoxyethylene(4)-2,2-bis(4-hydroxyphenyl)propane diacrylate, and compounds provided by replacing the acrylate in the preceding compounds with methacrylate), and polyester-type diacrylate compounds ("MANDA" from Nippon Kayaku Co., Ltd.).

Polyfunctional crosslinking agents can be exemplified by the following: pentaerythritol triacrylate, trimethylolethane triacrylate, trimethylolpropane triacrylate, tetramethylolmethane tetraacrylate, oligoester acrylate, and compounds provided by replacing the acrylate in the preceding compounds with methacrylate, and also triallyl cyanurate and triallyl trimellitate.

This crosslinking agent can be used, expressed with reference to 100 mass parts of the vinylic monomer components, at from 0.01 mass parts to 10.00 mass parts and preferably at from 0.03 mass parts to 5.00 mass parts.

Among these crosslinking agents, the aromatic divinyl compounds (particularly divinylbenzene) and the diacrylate compounds in which linkage is effected by a chain that has an aromatic group and an ether linkage, are examples of crosslinking agents that are favorably used from the standpoint of the low-temperature fixability and offset resistance.

The polymerization initiator used in the polymerization of the vinylic resin or vinylic polymer segment can be exemplified by the following: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides (e.g., methyl ethyl ketone peroxide, acetylacetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butyl cumyl peroxide, dicumyl peroxide, α,α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl)peroxycarbonate, acetylcyclohexylsulfonyl peroxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butylperoxy isopropyl carbonate, di-tert-butyl peroxyisophthalate, tert-butylperoxy allyl carbonate, tert-amylperoxy 2-ethylhexanoate, di-tert-butylperoxy hexahydroterephthalate, and di-tert-butylperoxy azelate.

When a hybrid resin is used in the present invention, a monomer component capable of reacting with both segments is preferably present in the vinylic polymer segment and/or the polyester segment. Among monomers that may constitute the polyester segment, monomers capable of reacting with the vinylic polymer segment can be exemplified by unsaturated dicarboxylic acids, e.g., fumaric acid, maleic acid, citraconic acid, and itaconic acid, and their anhydrides. Among monomers that may constitute the vinylic polymer segment, monomers capable of reacting with the polyester segment can be exemplified by monomers that have a carboxyl group or hydroxy group and by acrylate esters and methacrylate esters.

In a preferred method for obtaining a reaction product of the vinylic polymer segment and the polyester segment, a polymerization reaction for either resin or both resins is run in the presence of a polymer that contains a monomer component capable of reacting with each of the already described vinylic polymer segment and polyester segment.

In a preferred example of the method for obtaining the hybrid resin used in the present invention, the monomer that will constitute the vinylic polymer segment is reacted simultaneously or sequentially with the long-chain monomer and the monomer that will constitute the polyester segment.

The toner particle production method is not particularly limited in the present invention, and known production methods can be used. An example here is the so-called pulverization method, wherein the toner particles are obtained proceeding through a melt kneading step and a pulverization step: in the melt kneading step, the toner constituent materials, e.g., the resin component and optional colorant, release agent, charge control agent, and so forth, are uniformly mixed and then melt kneaded; in the pulverization step, the resulting melt-kneaded material is cooled and then pulverized using a pulverizer such as a jet mill.

With regard to other methods, the toner particles may also be produced by a so-called polymerization method, e.g., an emulsion polymerization method or a suspension polymerization method.

Among the preceding, the toner particles of the present invention are preferably toner particles obtained by proceeding through at least a melt kneading step and a pulverization step.

Proceeding through a melt kneading step is preferred because this facilitates controlling the previously described endothermic quantity percentage in the reversing heat flow to at least 20.0%.

The melt-kneading apparatus can be exemplified by twin-screw kneading extruders, hot rolls, kneaders, and extruders.

The melt kneading temperature is preferably controlled to provide a temperature of from 70° C. to 200° C. for the kneaded material. Control into this temperature range provides an excellent dispersibility for the crystalline polyester resin.

Toner particle production methods that proceed through at least a melt kneading step and a pulverization step are specifically described in the following, but this should not be construed as limiting.

The resin component and optional colorant, release agent, charge control agent, and other additives are thoroughly mixed using a mixer such as a Henschel mixer or ball mill (mixing step). The resulting mixture is melt kneaded using a heated kneader such as a twin-screw kneader extruder, hot roll, kneader, or extruder (melt kneading step). A release agent, magnetic iron oxide particles, and a metal-containing compound may also be added at this time. After the melt-kneaded material has been cooled and solidified, the toner particles are obtained by pulverization (pulverization step) and classification (classification step). As necessary, a toner may be obtained by additionally mixing the toner particles with an external additive in a mixer such as a Henschel mixer.

The mixer can be exemplified by the following: Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The kneader can be exemplified by the following: KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the following: Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

The toner of the present invention may be used in the form of a magnetic one-component toner, a nonmagnetic one-component toner, or a nonmagnetic two-component toner.

When used as a magnetic one-component toner, magnetic iron oxide particles are preferably used as the colorant. The magnetic iron oxide particles present in the magnetic one-component toner can be exemplified by magnetic iron oxides such as magnetite, maghemite, and ferrite and by magnetic iron oxides that contain another metal oxide; and metals such as Fe, Co, and Ni, or alloys between these metals and metals such as Al, Co, Cu, Pb, Mg, Ni, Sn, Zn, Sb, Be, Bi, Cd, Ca, Mn, Se, Ti, W, and V, and mixtures of the preceding.

The amount of magnetic iron oxide particle addition is preferably from 25 mass % to 45 mass % in the toner and is more preferably from 30 mass % to 45 mass % in the toner.

On the other hand, the colorant in the case of use as a nonmagnetic one-component toner or nonmagnetic two-component toner can be exemplified as follows.

A carbon black, e.g., furnace black, channel black, acetylene black, thermal black, lamp black, and so forth, can be used as a black pigment; a magnetic powder such as magnetite or ferrite may also be used as a black pigment.

Pigments and dyes can be used as favorable yellow colorants. The pigments can be exemplified by C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and by C.I. Vat Yellow 1, 3, and 20. The dyes can be exemplified by C.I. Solvent Yellow 19, 44, 77, 79, 81, 82, 93, 98, 103, 104, 112, and 162. A single one of these may be used or two or more may be used in combination.

Pigments and dyes can be used as favorable cyan colorants. The pigments can be exemplified by C.I. Pigment Blue 1, 7, 15, 15;1, 15;2, 15;3, 15;4, 16, 17, 60, 62, and 66 and by C.I. Vat Blue 6 and C.I. Acid Blue 45. The dyes can be exemplified by C.I. Solvent Blue 25, 36, 60, 70, 93, and 95. A single one of these may be used or two or more may be used in combination. Pigments and dyes can be used as favorable magenta colorants. The pigments can be exemplified by C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48;2, 48;3, 48;4, 49, 50, 51, 52, 53, 54, 55, 57, 57;1, 58, 60, 63, 64, 68, 81, 81;1, 83, 87, 88, 89, 90, 112, 114, 122, 123, 144, 146, 150, 163, 166, 169, 177, 184, 185, 202, 206, 207, 209, 220, 221, 238, and 254, and by C.I. Pigment Violet 19 and C.I. Vat Red 1, 2, 10, 13, 15, 23, 29, and 35. The magenta dyes can be exemplified by oil-soluble dyes such as C.I. Solvent Red 1, 3, 8, 23, 24, 25, 27, 30, 49, 52, 58, 63, 81, 82, 83, 84, 100, 109, 111, 121, and 122, C.I. Disperse Red 9, C.I. Solvent Violet 8, 13, 14, 21, and 27, and C.I. Disperse Violet 1, and by basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28. A single one of these may be used or two or more may be used in combination.

The amount of colorant addition, expressed with reference to 100.0 mass parts of the resin component, is preferably from 0.1 mass parts to 60.0 mass parts and is more preferably from 0.5 mass parts to 50.0 mass parts.

As necessary, a release agent (wax) may be used in the toner of the present invention in order to impart releasability to the toner.

Viewed in terms of the ease of dispersion in the toner particles and the extent of the releasability, this wax is preferably a hydrocarbon wax such as low molecular weight polyethylene, low molecular weight polypropylene, microcrystalline wax, paraffin wax, or Fischer-Tropsch wax. Aliphatic hydrocarbon waxes are an example of waxes whose use is particularly preferred. The following are examples of aliphatic hydrocarbon waxes: low molecular weight alkylene polymers provided by the radical polymerization of an alkylene under high pressures or provided by polymerization at low pressures using a Ziegler catalyst; alkylene polymers obtained by the pyrolysis of a high molecular weight alkylene polymer; synthetic hydrocarbon waxes obtained from the residual distillation fraction of hydrocarbon obtained by the Arge method from a synthesis gas containing carbon monoxide and hydrogen, and also the synthetic hydrocarbon waxes obtained by the hydrogenation of the former synthetic hydrocarbon waxes; and waxes provided by the fractionation of these aliphatic hydrocarbon waxes by a press sweating method, solvent method, use of vacuum distillation, or a fractional crystallization technique.

The following are examples of hydrocarbons that can be used as a source for aliphatic hydrocarbon waxes: hydrocarbon synthesized by the reaction of carbon monoxide and hydrogen using a metal oxide catalyst (frequently a multicomponent system that is a binary or higher system) (for example, hydrocarbon compounds synthesized by the Synthol method or Hydrocol method (use of a fluidized catalyst bed)); hydrocarbon having up to about several hundred carbon atoms, obtained by the Arge method (use of a fixed catalyst bed), which produces large amounts of waxy hydrocarbon; and hydrocarbon provided by the polymerization of an alkylene, e.g., ethylene, using a Ziegler catalyst.

One or two or more waxes may as necessary also be co-used in small amounts, and this co-used wax can be exemplified by the following:

oxides of aliphatic hydrocarbon waxes, such as oxidized polyethylene wax, and their block copolymers; waxes in which the major component is fatty acid ester, such as carnauba wax, sasol wax, and montanoic acid ester waxes; waxes provided by the partial or complete deacidification of fatty acid esters, such as deacidified carnauba wax; saturated straight-chain fatty acids such as palmitic acid, stearic acid, and montanoic acid; unsaturated fatty acids such as brassidic acid, eleostearic acid, and further, parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained by the hydrogenation of plant oils.

Specific examples of waxes are as follows: VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Sasol AG); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Petrolite Co., Ltd.); and Japan Wax, Beeswax, Rice Wax, Candelilla Wax, and Carnauba Wax (Cerarica NODA Co., Ltd.).

In order to efficiently obtain a release action, a release agent is used in the present invention that has a peak temperature for its endothermic peak of preferably from at least 100° C. to not more than 150° C. and more preferably from at least 100° C. to not more than 120° C.

With regard to the timing of release agent addition, it may be added, in the case of toner production by the pulverization method, during melt kneading or during production of the toner resin. A single release agent may be used or combinations of release agents may be used. The release agent is preferably added at from 1 mass parts to 20 mass parts per 100 mass parts of the resin component.

A charge control agent can be used in the toner of the present invention in order to stabilize its triboelectric charging characteristics. While the charge control agent content will also vary by a function of its type and the properties of the other materials that make up the toner particles, it is generally preferably from 0.1 mass parts to 10.0 mass parts per 100 mass parts of the resin component in the toner particles, while from 0.1 mass parts to 5.0 mass parts is more preferred.

Charge control agents that control the toner to a negative chargeability and charge control agents that control the toner to a positive chargeability are known, and one or two or more of the various charge control agents can be used in conformity to the type and application of the toner.

The following are examples of charge control agents for controlling the toner to a negative chargeability: organometal complexes (monoazo metal complexes, acetylacetone metal complexes) and the metal complexes and metal salts of aromatic hydroxycarboxylic acids and aromatic dicarboxylic acids. Additional examples for controlling the toner to a negative chargeability are aromatic mono- and polycarboxylic acids and their metal salts, anhydrides and esters; and phenol derivatives such as bisphenols. Particularly preferred for use among the preceding are the metal complexes and metal salts of aromatic hydroxycarboxylic acids, with which a stable charging performance can be obtained.

The following are examples of charge control agents for controlling the toner to a positive chargeability: nigrosine and its modifications by fatty acid metal salts; quaternary ammonium salts such as tributylbenzylammonium 1-hydroxy-4-naphthosulfonate and tetrabutylammonium tetrafluoroborate and their analogues; onium salts such as phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanic acid, and ferrocyanic acid); and metal salts of higher fatty acids. A single one of these or a combination of two or more can be used by the present invention. Charge control agents such as nigrosine compounds and quaternary ammonium salts are preferred among the preceding for the charge control agent that controls the toner to a positive chargeability.

Specific examples are Spilon Black TRH, T-77, T-95, and TN-105 (Hodogaya Chemical Co., Ltd.); BONTRON (registered trademark) S-34, S-44, E-84, and E-88 (Orient Chemical Industries Co., Ltd.); TP-302 and TP-415 (Hodogaya Chemical Co., Ltd.); BONTRON (registered trademark) N-01, N-04, N-07, and P-51 (Orient Chemical Industries Co., Ltd.); and Copy Blue PR (Clariant).

A charge control resin may also be used, and it may also be used in combination with the charge control agents cited above.

The toner of the present invention may be mixed with a carrier and used as a two-component developer. An ordinary carrier such as ferrite or magnetite or a resin-coated carrier can be used as the carrier. Also usable are binder-type carriers in which a magnetic powder is dispersed in a resin.

A resin-coated carrier is composed of a carrier core particle and a coating material, this latter being a resin that covers (coats) the surface of the carrier core particle. The resin used for this coating material can be exemplified by styrene-acrylic resins such as styrene-acrylate ester copolymers and styrene-methacrylate ester copolymers; acrylic resins such as acrylate ester copolymers and methacrylate ester copolymers; fluorine-containing resins such as polytetrafluoroethylene, monochlorotrifluoroethylene polymers, and polyvinylidene fluoride; silicone resins; polyester resins; polyamide resins; polyvinyl butyrals; and aminoacrylate resins. Additional examples are ionomer resins and polyphenylene sulfide resins. A single one of these resins may be used or a plurality may be used in combination.

In order to improve the charge stability, the durability of the developing performance, the flowability, and the durability, in a preferred embodiment of the toner of the present invention a finely divided silica powder is added to the toner particles as an external additive.

This finely divided silica powder has a specific surface area by the nitrogen adsorption-based BET method preferably of at least 30 $m^2/g$ and more preferably of from 50 $m^2/g$ to 400 $m^2/g$. The finely divided silica powder is used, expressed per 100 mass parts of the toner particles, preferably at from 0.01 mass parts to 8.00 mass parts and more preferably at from 0.10 mass parts to 5.00 mass parts. The BET specific surface area of the finely divided silica powder can be determined using a multipoint BET method by the adsorption of nitrogen gas to the surface of the finely divided silica powder using, for example, an Autosorb 1 specific surface area analyzer (Yuasa Ionics Co., Ltd.), a GEMINI 2360/2375 (Micromeritics Instrument Corporation), or a TriStar-3000 (Micromeritics Instrument Corporation).

For the purpose of hydrophobing and controlling the triboelectric charging characteristics, the finely divided silica powder is optionally preferably also treated with a treatment agent, e.g., an unmodified silicone varnish, various modified silicone varnishes, an unmodified silicone oil, various modified silicone oils, a silane coupling agent, a functional group-bearing silane compound, or other organosilicon compounds, or with a combination of different treatment agents. Other external additives may also be added to the toner of the present invention on an optional basis. These external additives can be exemplified by finely divided resin particles and inorganic fine powders that function as auxiliary charging agents, agents that impart electroconductivity, flowability-imparting agents, anti-caking agents, release agents for hot roll fixing, lubricants and abrasives. The lubricant can be exemplified by polyethylene fluoride powders, zinc stearate powders, and polyvinylidene fluoride powders. The abrasive can be exemplified by cerium oxide powders, silicon carbide powders, and strontium titanate powders. Strontium titanate powders are preferred among the preceding.

EXAMPLES

The present invention is specifically described below using examples. However, the embodiments of the present invention are in no way limited by these examples. Unless specifically indicated otherwise, the number of parts and % in the examples and comparative examples are in all instances on a mass basis.

Polyester-Type Resin (A-1) Production Example

| | |
|---|---|
| ethylene oxide adduct of bisphenol A (2.2 mol adduct) | 100.0 mol parts |
| terephthalic acid | 60.0 mol parts |
| trimellitic anhydride | 20.0 mol parts |
| acrylic acid | 10.0 mol parts |

60 mass parts of a mixture of these polyester monomers and secondary monohydric aliphatic saturated alcohols (long-chain monomer) having a peak value of the number of carbon atom of 70, which are added so as to provide 5.0 mass % with reference to the total polyester-type resin, was introduced into a four-neck flask. A pressure-reduction apparatus, water separator, nitrogen gas introduction apparatus, temperature measurement apparatus, and stirrer were installed for the four-neck flask and stirring was carried out at 160° C. under a nitrogen atmosphere. To this was added dropwise, over 4 hours from a dropping funnel, a mixture of 2.0 mol parts of benzoyl peroxide as polymerization initiator and 40 mass parts of a vinylic polymer monomer (styrene: 100.0 mol parts) that would compose a vinylic polymer segment. This was followed by reaction for 5 hours at 160° C. and then heating to 230° C., the addition of 0.2 mass % of dibutyltin oxide, and control of the reaction time so as to provide the desired viscosity.

After the completion of the reaction, removal from the vessel, cooling, and pulverization yielded polyester-type resin (A-1). The properties of the obtained polyester-type resin (A-1) are shown in Table 1.

Polyester-Type Resins (A-2) to (A-10) Production Examples

Polyester-type resins (A-2) to (A-10) were obtained proceeding as in the Polyester-Type Resin (A-1) Production Example, but changing over to the monomer formulations indicated in Tables 1 and 2. The properties of these resins are given in Table 1.

Polyester-Type Resins (A-11) to (A-13) Production Examples

The monomers indicated in Tables 1 and 2 were introduced into a 5-L autoclave along with 0.2 mass % of dibutyltin oxide with reference to the total amount of the monomer. A reflux condenser, water separator, nitrogen gas introduction tube, thermometer, and stirrer were installed and a polycondensation reaction was run at 230° C. while introducing nitrogen gas into the autoclave. The reaction time was adjusted so as to provide the desired softening point. After the completion of the reaction, removal from the vessel, cooling, and pulverization yielded polyester-type resins (A-11) to (A-13). The properties of these resins are given in Table 1.

Crystalline Polyester Resin (B-1) Production Example

| | |
|---|---|
| 1,12-dodecanediol | 100.0 mol parts |
| sebacic acid | 100.0 mol parts |

These monomers and 0.2 mass % of dibutyltin oxide with reference to the total amount of monomer were introduced into a 10-L four-neck flask equipped with a nitrogen introduction tube, a dewatering pipe, a stirrer, and a thermocouple. A reaction was run for 4 hours at 180° C. followed by heating to 210° C. at 10° C./1 hour, holding for 8 hours at 210° C., and then reacting for 1 hour at 8.3 kPa, thereby yielding a crystalline polyester resin (B-1).

The following are given in Table 3 for the resulting crystalline polyester resin (B-1): the peak temperature of the endothermic peak in the total heat flow measured by temperature-modulated DSC, the weight-average molecular weight, and the number-average molecular weight.

Crystalline Polyester Resins (B-2) to (B-6) Production Examples

Crystalline polyester resins (B-2) to (B-6) were obtained proceeding as in the Crystalline Polyester Resin (B-1) Production Example, but changing over to the monomer formulations given in Table 3. The properties of these resins are given in Table 3.

Example 1

| | |
|---|---|
| polyester-type resin (A-1) | 60 mass parts |
| polyester-type resin (A-13) | 40 mass parts |
| crystalline polyester resin (B-1) | 2.5 mass parts |
| magnetic iron oxide particles (number-average particle diameter = 0.13 μm, Hc = 11.5 kA/m, σs = 88 $Am^2/kg$, σr = 14 $Am^2/kg$) | 60 mass parts |
| release agent; Fischer-Tropsch wax (C105 from Sasol, melting point = 105° C.) | 2 mass parts |
| charge control agent (T-77, Hodogaya Chemical Co., Ltd.) | 2 mass parts |

These materials were pre-mixed with a Henschel mixer and subsequently melt kneaded using a twin-screw kneading extruder (model PCM-30 from Ikegai Ironworks Corporation).

The resulting kneaded material was cooled and coarsely pulverized with a hammer mill. This was followed by pulverization with a mechanical pulverizer (T-250 from Turbo Kogyo Co., Ltd.) to yield a finely pulverized powder, which was classified using a Coanda effect-based multi-grade classifier to obtain negative-charging toner particles with a weight-average particle diameter (D4) of 7.0 μm.

| | |
|---|---|
| toner particles | 100 mass parts |
| finely divided hydrophobic silica powder 1 (BET specific surface area = 150 $m^2/g$, hydrophobically treated with 30 mass parts of hexamethyldisilazane (HMDS) and 10 mass parts of dimethylsilicone oil per 100 mass parts of the finely divided silica powder) | 1.0 mass part |
| finely divided strontium titanate powder (median diameter: 1.0 μm) | 0.6 mass parts |

These materials were introduced into a Henschel mixer (model FM-75 from Mitsui Miike Chemical Engineering Machinery Co., Ltd.) and mixing and external addition were carried out, followed by sieving on a mesh with an aperture of 150 μm to obtain a toner (T-1).

The following evaluations were performed on the resulting toner (T-1).

<Measurement by Temperature-Modulated DSC>

The obtained toner (T-1) was submitted to temperature-modulated DSC measurement using the method described above, and the following were determined using the derivation method described above on the endothermic peak or peaks present in the temperature range from 50° C. to 100° C.: the peak temperature for each endothermic peak, the endothermic quantity ΔH1 for each endothermic peak in the total heat flow, and the percentage (%) of the endothermic quantity in the reversing heat flow with reference to the endothermic quantity in the total heat flow for each endothermic peak. The results are given in Table 5.

<Evaluation Test for the Storability>

10 g of the toner was measured into a 50-mL plastic cup and this was allowed to stand for 3 days in a 55° C. thermostat. After the standing period, the toner was visually inspected and the storability was evaluated using the following criteria.

A: Rapid loosening when the cup is rotated.

B: Lumps are present, but are diminished and loosened by rotating the cup.

C: Lumps remain even though loosened up by rotating the cup.

D: Large lumps are present and are not loosened even when the cup is rotated.

The results are given in Table 5.

<Low-Temperature Fixability Test>

For the low-temperature fixability, an external fixing unit was used as provided by removing the fixing unit from a Hewlett-Packard laser beam printer (HP LASERJET Enterprise 600 M603) to the outside, making the temperature of the fixing unit freely settable, and modifying the process speed to 440 mm/sec.

Using this apparatus, an unfixed image with a toner laid-on level per unit surface area set to 0.5 $mg/cm^2$ was passed in a normal temperature, normal humidity environment (temperature=23.5° C., humidity=60% RH) or a low temperature, low humidity environment (temperature=15° C., humidity=10% RH) through the fixing unit, which had been set at 160° C. "Plover Bond paper" (105 $g/m^2$, from the Fox River Paper Co.) was used as the recording medium. The obtained fixed image was rubbed with lens cleaning paper under a load of 4.9 kPa (50 $g/cm^2$), and the decline (%) in the image density pre-versus-post-rubbing was evaluated. The image density was measured using a Macbeth reflection densitometer (Macbeth) with an SPI filter.

A: The decline in the image density is less than 5.0%.

B: The decline in the image density is at least 5.0% but less than 10.0%.

C: The decline in the image density is at least 10.0% but less than 15.0%.

D: The decline in the image density is at least 15.0%.

The results are given in Table 5.

<The Low-Temperature Fixability Pre- and Post-Standing in a High Temperature, High Humidity Environment>

Toner (T-1) was allowed to stand for 30 days in a thermostat/humidistat at a temperature of 40° C. and a humidity of 95% RH. After the standing period, the value of the temperature difference ΔTg (=Tg post-standing−Tg pre-standing) in the glass transition temperature (Tg: ° C.) pre-versus-post-standing was determined by temperature-modulated DSC measurements. The results are given in Table 5. In addition, an evaluation of the low-temperature fixability was carried out in a normal temperature, normal humidity environment (temperature=23.5° C., humidity=60% RH) on the post-standing toner using the same conditions as in the previously described low-temperature fixability test. The results are given in Table 5.

<Evaluation of the Developing Performance Durability>

A Hewlett-Packard laser beam printer (HP LASERJET Enterprise 600 M603) was used to evaluate the developing performance durability; the machine used for the evaluation had a process speed modified to 440 mm/s.

An image-output test was run in a high temperature, high humidity environment (temperature=32.5° C., humidity=80% RH) and a low temperature, low humidity environment (temperature=15° C., humidity=10% RH) using an A4 size document with an image area of 2% and 75 g/m$^2$ A4 size transfer paper. The percentage decline in the image density relative to the 100th print was determined after 20,000 sheets of paper had been run through.

For the image density, the reflection density of the solid black area of the test chart image was measured using a Macbeth reflection densitometer (Macbeth) with an SPI filter, and the average for 5 points was calculated. The evaluation criteria are as follows.

A: The decline in the image density is less than 3.0%.

B: The decline in the image density is at least 3.0, but less than 6.0%.

C: The decline in the image density is at least 6.0%, but less than 10.0%.

D: The decline in the image density is at least 10.0%.

The results are given in Table 5.

Examples 2 to 9

Toners (T-2) to (T-9) were prepared proceeding as in Example 1 using the formulations indicated in Table 4. The resulting toners were submitted to the same evaluations as in Example 1. The results are given in Table 5.

Example 10

| | |
|---|---|
| polyester-type resin (A-1) | 60 mass parts |
| polyester-type resin (A-13) | 40 mass parts |
| crystalline polyester resin (B-1) | 2.5 mass parts |
| carbon black | 5 mass parts |
| release agent; Fischer-Tropsch wax (C105 from Sasol, melting point = 105° C.) | 2 mass parts |
| charge control agent (T-77, Hodogaya Chemical Co., Ltd.) | 2 mass parts |

These materials were pre-mixed with a Henschel mixer and subsequently melt kneaded using a twin-screw kneading extruder.

The resulting kneaded material was cooled and coarsely pulverized with a hammer mill. This was followed by pulverization with a jet mill to yield a finely pulverized powder, which was classified using a Coanda effect-based multi-grade classifier to obtain negative-charging toner particles with a weight-average particle diameter (D4) of 7.0 μm.

To 100 mass parts of the obtained toner particles were added 1.0 mass part of finely divided titanium oxide particles (number-average primary particle diameter=50 nm, surface-treated with 15 mass % isobutyltrimethoxysilane) and 0.8 mass parts of finely divided hydrophobic silica particles (number-average primary particle diameter=16 nm, surface-treated with 20 mass % hexamethyldisilazane); external addition and mixing were then carried out with a Henschel mixer (model FM-75 from Mitsui Miike Chemical Engineering Machinery Co., Ltd.) followed by sieving on a mesh with an aperture of 150 μm to obtain a toner (T-10).

Toner (T-10) was evaluated as described in Example 1, but using the low-temperature fixability evaluation described below and the developing performance durability evaluation described below. The results are given in Table 5.

<Evaluation of the Low-Temperature Fixability>

The evaluation was performed proceeding as in Example 1, but changing the temperature setting in the evaluation procedure of Example 1 to 140° C. The results are given in Table 5.

<Evaluation of the Developing Performance Durability>

The developing performance was evaluated as in Example 1, but in this case using an evaluation machine provided by modifying the process speed of a Hewlett-Packard laser beam printer (HP Color LASERJET CP6015xh) to 440 mm/s. The results are given in Table 5.

Comparative Examples 1 to 5

Toners (T-11) to (T-15) were produced proceeding as in Example 1 using the formulations indicated in Table 4. For toner (T-13), 9.0 mass parts is used for the amount of addition of the crystalline polyester resin (B-1) and the release agent is changed to 6.0 mass parts of a paraffin wax (HNP-9, melting point=75° C., weight-average molecular weight (Mw)=1100, Nippon Seiro Co., Ltd.).

The same evaluations as in Example 1 were performed on the resulting toners. The results are given in Table 6.

Comparative Example 6

The toner (T-16) used in Comparative Example 6 was produced as follows.

(Amorphous Polyester Resin Dispersion (1))

bisphenol A/2 mol ethylene oxide adduct: 60 mol % bisphenol A/2 mol propylene oxide adduct: 40 mol % dimethyl terephthalate: 65 mol % dodecenylsuccinic acid: 30 mol % trimellitic acid: 5 mol %

(Above, 100 mol % is used both for the alcohol component and for the acid component. The same basis is also used below.)

The monomer with the composition ratio indicated above was introduced into a 5-L flask fitted with a stirrer, a nitrogen introduction tube, a temperature sensor, and a rectifying column; the temperature was raised to 190° C. over 1 hour; and, after confirming that the reaction system was being stirred without irregularities, 1.0 mass % of dibutyltin oxide was introduced. The temperature was raised to 240° C. over 6 hours from 190° C. while distilling out the produced water, and the dehydration condensation reaction was continued for an additional 2 hours at 240° C. to obtain a branched amorphous polyester resin (1) having a glass transition temperature of 58° C., an acid value of 15.0 mg KOH/g, a weight-average molecular weight of 40,000, and a number-average molecular weight of 6500.

An ethyl acetate/isopropyl alcohol mixed solvent in an amount sufficient to dissolve the resin was introduced into a 5-L separable flask and the aforementioned resin was gradually introduced thereinto with stirring with a Three-One Motor to effect dissolution, thus yielding an oil phase. A suitable amount of a dilute aqueous ammonia solution was added dropwise to this stirred oil phase and ion-exchanged water was additionally added dropwise to bring about phase-inversion emulsification, and the solvent was removed under reduced pressure on an evaporator to obtain an amorphous polyester resin dispersion (1). (The resin particle concentration was brought to 30 mass % by adjustment with ion-exchanged water).

(Amorphous Polyester Resin Dispersion (2))

bisphenol A/2 mol ethylene oxide adduct: 15 mol % bisphenol A/2 mol propylene oxide adduct: 85 mol % terephthalic acid: 50 mol % fumaric acid: 30 mol % dodecenylsuccinic acid: 20 mol %

The monomer with the composition ratio indicated above was introduced into a 5-L flask fitted with a stirrer, a nitrogen introduction tube, a temperature sensor, and a rectifying column; the temperature was raised to 190° C. over 1 hour; and, after confirming that the reaction system was being stirred without irregularities, 1.0 mass % of dibutyltin oxide was introduced. The temperature was raised to 240° C. over 6 hours from 190° C. while distilling out the produced water, and the dehydration condensation reaction was continued for an additional 2 hours at 240° C. to obtain a straight-chain amorphous polyester resin (2) having a glass transition temperature of 58° C., an acid value of 16 mg KOH/g, a weight-average molecular weight of 15,000, and a number-average molecular weight of 5500.

An ethyl acetate/isopropyl alcohol mixed solvent in an amount sufficient to dissolve the resin was introduced into a 5-L separable flask and the aforementioned resin was gradually introduced thereinto with stirring with a Three-One Motor to effect dissolution, thus yielding an oil phase. A suitable amount of a dilute aqueous ammonia solution was added dropwise to this stirred oil phase and ion-exchanged water was additionally added dropwise to bring about phase-inversion emulsification, and the solvent was removed under reduced pressure on an evaporator to obtain an amorphous polyester resin dispersion (2). (The resin particle concentration was brought to 30 mass % by adjustment with ion-exchanged water).

(Crystalline Polyester Resin Dispersion (3))

crystalline polyester resin (B-5): 90 mass parts anionic surfactant: 2 mass parts (Neogen RK, Dai-ichi Kogyo Seiyaku Co., Ltd.)

ion-exchanged water: 210 mass parts

The preceding were mixed and heated to 100° C. After dispersion with an Ultra-Turrax T50 from IKA, heating to 110° C. and a dispersion treatment were performed for 1 hour with a pressure discharge-type Gaulin homogenizer, thereby yielding a crystalline polyester resin dispersion (3) having a volume-average particle diameter of 0.15 μm and a solids fraction of 30 mass %.

(Colorant-Dispersed Solution)

| | |
|---|---|
| cyan pigment (ECB-301 from Dainichiseika Color & Chemicals Mfg. Co., Ltd.) | 20 mass parts |
| anionic surfactant (Neogen SC from Dai-ichi Kogyo Seiyaku Co., Ltd.) | 2 mass parts |
| ion-exchanged water | 78 mass parts |

These materials were mixed and were dispersed for 5 minutes at 6000 rpm using an homogenizer (Ultra-Turrax T50 from IKA), followed by defoaming by stirring for 24 hours with a stirrer. The dispersion was then dispersed at a pressure of 240 MPa using an Ultimizer high-pressure impact-type disperser (HJP30006 from Sugino Machine Limited). The dispersion was run for the equivalent of 25 passes. This was followed by the addition of ion-exchanged water to adjust the solids concentration to 25 mass %, thereby yielding a colorant-dispersed solution.

(Release Agent Dispersion (1))

paraffin wax FNP92: 45 mass parts (melting point=91° C., weight-average molecular weight Mw=2100, Nippon Seiro Co., Ltd.)

anionic surfactant: 5 mass parts (Neogen RK, Dai-ichi Kogyo Seiyaku Co., Ltd.)

ion-exchanged water: 200 mass parts

The preceding were heated to 60° C., thoroughly dispersed with an Ultra-Turrax T50 from IKA, and then subjected to a dispersion treatment with a pressure discharge-type Gaulin homogenizer to obtain a release agent dispersion (1) with a solids fraction of 25 mass %.

(Toner Production)

ion-exchanged water: 280 mass parts amorphous polyester resin dispersion (1): 150 mass parts amorphous polyester resin dispersion (2): 150 mass parts crystalline polyester resin dispersion (3): 67 mass parts anionic surfactant: 2.8 mass parts (Neogen RK, Dai-ichi Kogyo Seiyaku Co., Ltd.)

The preceding were introduced into a 3-L reactor fitted with a thermometer, pH meter, and stirrer and were held for 30 minutes at a stirrer rotation rate of 150 rpm at a temperature of 30° C. while controlling the temperature from the outside using a heating mantle.

This was followed by the introduction of 60 mass parts of the colorant-dispersed solution and 80 mass parts of the release agent dispersion (1) and holding for 5 minutes. While in this state the pH was adjusted to 3.0 by adding a 1.0 mass % aqueous solution of nitric acid. 0.4 mass parts polyaluminum chloride was added while carrying out dispersion with an homogenizer (Ultra-Turrax T50 from IKA Japan). This was followed by raising the temperature to 50° C. while stirring and measuring the particle diameter using a Multisizer II (aperture diameter: 50 μm, from Beckman Coulter, Inc.). 90 mass parts of the amorphous polyester resin dispersion (1) and 90 mass parts of the amorphous polyester resin dispersion (2) were introduced when the volume-average particle diameter reached 5.5 μm. After holding for 30 minutes after this introduction, the pH was brought to 9.0 using a 5 mass % aqueous sodium hydroxide solution. This was followed by raising the temperature to 90° C. and holding for 3 hours at 90° C. and then cooling, filtration, redispersion in ion-exchanged water, and filtration. Repetitive washing was performed until the electrical conductivity of the filtrate was 20 μS/cm or less. Vacuum-drying for 5 hours in a 40° C. oven then yielded toner particles.

| | |
|---|---|
| toner particles | 100 mass parts |
| hydrophobic silica (silica particles surface-treated with dimethylsilicone oil, number-average primary particle diameter = 40 nm) | 1.5 mass parts |
| hydrophobic titanium oxide (the surface of the titanium oxide particles has been chemically treated with octylsilane, number-average primary particle diameter = 20 nm) | 1.0 mass part |

These materials were introduced into a sample mill and were mixed for 30 seconds at 10,000 rpm. The toner (T-16) was then obtained by sieving on a vibrating screen having an aperture of 45 μm.

The same evaluations as in Example 10 were run on the resulting toner (T-16). The results are given in Table 6.

Comparative Example 7

The toner (T-17) used in Comparative Example 7 was produced as follows.

(Polyester Prepolymer Synthesis)

The following materials were introduced into a reactor fitted with a nitrogen introduction tube, a dewatering pipe, a stirrer, and a thermocouple.

| | |
|---|---|
| bisphenol A/2 mol ethylene oxide adduct | 682 parts |
| bisphenol A/2 mol propylene oxide adduct | 81 parts |
| terephthalic acid | 283 parts |
| trimellitic anhydride | 22 parts |
| dibutyltin oxide | 2 parts |

Then, after reacting for 7 hours at 230° C., a reaction was run for 5 hours at 10 to 15 mmHg to obtain a hydroxyl group-bearing polyester. This hydroxyl group-bearing polyester had a glass transition temperature of 54° C.

410 parts of the hydroxyl group-bearing polyester, 89 parts of isophorone diisocyanate, and 500 parts of ethyl acetate were then introduced into a reactor fitted with a nitrogen introduction tube, a dewatering pipe, a stirrer, and a thermocouple and a reaction was run for 5 hours at 100° C. to obtain a polyester prepolymer.

(Amorphous Polyester Synthesis)

The following materials were introduced into a reactor fitted with a nitrogen introduction tube, a dewatering pipe, a stirrer, and a thermocouple.

| | |
|---|---|
| bisphenol A/2 mol ethylene oxide adduct | 290 parts |
| bisphenol A/3 mol propylene oxide adduct | 480 parts |
| isophthalic acid | 100 parts |
| terephthalic acid | 108 parts |
| adipic acid | 46 parts |
| dibutyltin oxide | 2 parts |

Then, after reacting for 10 hours at 230° C., a reaction was run for 5 hours at 10 to 15 mmHg. 30 parts trimellitic anhydride was then added and a reaction was run for 3 hours at 180° C. to obtain an amorphous polyester. This amorphous polyester had a glass transition temperature of 48° C.

(Ketimine Synthesis)

170 parts of isophoronediamine and 75 parts of methyl ethyl ketone were introduced into a reactor fitted with a stirring rod and a thermometer and a reaction was run for 5 hours at 50° C. to obtain the ketimine. This ketimine had an amine value of 418 mg KOH/g.

(Production of the Aqueous Medium)

The following materials were introduced into a reactor fitted with a stirring rod and a thermometer.

| | |
|---|---|
| water | 683 parts |
| Eleminol RS-30 | 11 parts |

(the sodium salt of a sulfate ester of an ethylene oxide adduct on methacrylic acid; Sanyo Chemical Industries, Ltd.)

| | |
|---|---|
| styrene | 83 parts |
| methacrylic acid | 83 parts |
| butyl acrylate | 110 parts |
| ammonium persulfate | 1 part |

Then, after stirring for 15 minutes at 400 rpm, the temperature was raised to 75° C. and a reaction was run for 5 hours. 30 parts of a 1 mass % aqueous ammonium persulfate solution was then added and maturation was carried out for 5 hours at 75° C. to obtain a resin particle dispersion. The resin particles were isolated by drying a portion of this resin particle dispersion, and the glass transition temperature of these resin particles was 72° C.

The following were mixed to obtain an aqueous medium 1: 990 parts of water, 83 parts of the resin particle dispersion, 37 parts of Eleminol MON-7 (48.3 mass % aqueous solution of sodium dodecyldiphenyl ether disulfonate, from Sanyo Chemical Industries, Ltd.), and 90 parts of ethyl acetate.

(Toner Production)

The following were mixed using a Henschel mixer (Mitsui Mining Co., Ltd.): 1200 parts of water, 540 parts of a carbon black having a DBP oil absorption of 42 mL/100 mg and a pH of 9.5 (Printex 35 from Degussa), and 1200 parts of the amorphous polyester. Using a two-roll mill, the resulting mixture was kneaded for 3 hours at 150° C. and was then rolled and cooled and pulverized using a pulverizer to obtain a masterbatch 1.

378 parts of the amorphous polyester, 100 parts of HNP-9 (melting point=75° C., weight-average molecular weight Mw=1100, from Nippon Seiro Co., Ltd.), and 947 parts of ethyl acetate were introduced into a vessel equipped with a stirring rod and a thermometer and were heated to 80° C. and held for 5 hours at 80° C. followed by cooling to 30° C. over 1 hour. 500 parts of masterbatch 1 and 500 parts of ethyl acetate were then added and mixing was performed for 1 hour to obtain a mixture. 1324 parts of this mixture was transferred to a vessel and dispersion was carried out for 3 passes using an Ultraviscomill bead mill (Aimex Co., Ltd.) and a liquid feed rate of 1 kg/hour, a disk peripheral velocity of 6 m/s, and an 80 volume % fill with zirconia beads having a particle diameter of 0.5 mm. 1042 parts of a 65 mass % ethyl acetate solution of amorphous polyester was then added and a dispersion (1) was prepared using an Ultraviscomill bead mill (Aimex Co., Ltd.) for 1 pass under the conditions indicated above.

100 g of crystalline polyester resin (B-6) and 400 g of ethyl acetate were introduced into a 2-L metal vessel; heating to 75° C. was carried out to effect dissolution; and quenching at a rate of temperature decline of 27° C./minute was subsequently carried out on an ice water bath. 500 mL of glass beads with a diameter of 3 mm was then added and a dispersion (2) was prepared by milling for 10 hours using a batch-type sand mill (Kanpe Hapio Co., Ltd.).

680 parts of the dispersion (1), 73.9 parts of the dispersion (2), 109.4 parts of the polyester prepolymer, and 4.6 parts of the ketimine were introduced into a vessel; mixing was carried out for 1 minute at 5000 rpm using a TK Homomixer (Tokushu Kika Kogyo Co., Ltd.); 1200 parts of the aqueous medium 1 was added and mixing was carried out for 25 minutes at 13,000 rpm using a TK Homomixer to produce an emulsified slurry.

The emulsified slurry was introduced into a vessel fitted with a stirrer and a thermometer; solvent removal was carried out for 8 hours at 30° C.; and maturation was then carried out for 4 hours at 45° C. to produce a dispersed slurry.

100 parts of this dispersed slurry was filtered under reduced pressure. 100 parts of water was added to the resulting filter cake and mixing was performed for 10 minutes at 12,000 rpm using a TK Homomixer (Tokushu Kika Kogyo Co., Ltd.) followed by filtration. 100 parts of a 10 mass % aqueous sodium hydroxide solution was added to the resulting filter cake and mixing was carried out for 30 minutes at 12,000 rpm using a TK Homomixer (Tokushu Kika Kogyo Co., Ltd.)

followed by filtration under reduced pressure. 100 parts of 10 mass % hydrochloric acid was added to the resulting filter cake and mixing was carried out for 10 minutes at 12,000 rpm using a TK Homomixer (Tokushu Kika Kogyo Co., Ltd.) followed by filtration. The following procedure was performed twice: addition of 300 parts of water to the resulting filter cake; mixing for 10 minutes at 12,000 rpm using a TK Homomixer (Tokushu Kika Kogyo Co., Ltd.); and filtration. The resulting filter cake was dried for 48 hours at 45° C. using a convection dryer followed by screening on a mesh with an aperture of 75 μm to obtain toner particles.

| | |
|---|---|
| toner particles | 100 mass parts |
| hydrophobically treated silica with a number-average particle diameter of 13 nm | 0.7 mass parts |
| hydrophobically treated titanium oxide with a number-average particle diameter of 13 nm | 0.3 mass parts |

These materials were introduced into a Henschel mixer and were mixed to obtain a toner (T-17).

The same evaluations as in Example 10 were run on the resulting toner (T-17). The results are given in Table 6.

TABLE 1

| polyester-type resin No. | polyester (PES) segment (*1) BPA-PO (mol parts) | BPA-EO (mol parts) | TPA (mol parts) | IPA (mol parts) | DMT (mol parts) | TMA (mol parts) | acrylic acid (mol parts) | vinylic polymer segment (*2) St (mol parts) | 2EHA (mol parts) | PES segment/vinylic polymer segment (mass ratio) | Tg (° C.) | Tm (° C.) |
|---|---|---|---|---|---|---|---|---|---|---|---|---|
| A-1 | — | 100.0 | 60.0 | — | — | 20.0 | 10.0 | 100 | — | 60/40 | 60.9 | 130.1 |
| A-2 | 95.0 | 5.0 | 50.0 | — | — | 24.0 | 10.0 | 60 | 40 | 70/30 | 61.2 | 129.6 |
| A-3 | 50.0 | 50.0 | 50.0 | — | — | 24.0 | 10.0 | 60 | 40 | 70/30 | 59.3 | 127.2 |
| A-4 | — | 100.0 | 60.0 | — | — | 20.0 | 10.0 | 100 | — | 60/40 | 57.6 | 118.6 |
| A-5 | — | 100.0 | 60.0 | — | — | 20.0 | 10.0 | — | — | 100/0 | 56.2 | 117.5 |
| A-6 | — | 100.0 | 60.0 | — | — | 20.0 | 10.0 | 100 | — | 90/10 | 58.9 | 119.5 |
| A-7 | — | 100.0 | 60.0 | — | — | 20.0 | 10.0 | 100 | — | 40/60 | 59.2 | 121.1 |
| A-8 | — | 100.0 | 60.0 | — | — | 20.0 | 10.0 | 100 | — | 50/50 | 57.3 | 118.1 |
| A-9 | — | 100.0 | 60.0 | — | — | 20.0 | — | — | — | 100/0 | 56.3 | 117.8 |
| A-10 | — | 100.0 | 60.0 | — | — | 20.0 | 10.0 | 100 | — | 60/40 | 58.5 | 119.5 |
| A-11 | 66.0 | 34.0 | — | 20.0 | 33.0 | — | — | — | — | 100/0 | 59.5 | 120.1 |
| A-12 | 70.0 | 30.0 | 43.0 | 40.0 | — | 16.0 | — | — | — | 100/0 | 55.2 | 124.1 |
| A-13 | 60.0 | 40.0 | 77.0 | — | — | — | — | — | — | 100/0 | 50.1 | 89.6 |

BPA-PO: bisphenol A/propylene oxide adduct (2.2 mol adduct)
BPA-EO: bisphenol A/ethylene oxide adduct (2.2 mol adduct)
DSA: dodecenylsuccinic anhydride
TPA: terephthalic acid
TMA: trimellitic anhydride
IPA: isophthalic acid
DMT: dimethyl terephthalate
St: styrene
2EHA: 2-ethylhexyl acrylate
(*1) The mol parts for the monomer in the table indicates the ratio when 100 mol parts is assigned to the total amount of the alcohol component (excluding the long-chain monomer).
(*2) The mol parts for the monomer in the table indicates the ratio when 100 mol parts is assigned to the total amount of the vinylic monomer component.

TABLE 2

| polyester-type resin No. | type of long-chain monomer | number of carbon atom of long-chain monomer (peak value) | amount of long-chain monomer (mass %) (*3) |
|---|---|---|---|
| A-1 | secondary aliphatic saturated alcohol (monohydric) | 70 | 5.0 |
| A-2 | secondary aliphatic saturated alcohol (monohydric) | 70 | 5.0 |

TABLE 2-continued

| polyester-type resin No. | type of long-chain monomer | number of carbon atom of long-chain monomer (peak value) | amount of long-chain monomer (mass %) (*3) |
|---|---|---|---|
| A-3 | secondary aliphatic saturated alcohol (monohydric) | 70 | 5.0 |
| A-4 | secondary aliphatic saturated alcohol (monohydric) | 70 | 5.0 |
| A-5 | secondary aliphatic saturated alcohol (monohydric) | 70 | 10.0 |
| A-6 | secondary aliphatic saturated alcohol (monohydric) | 102 | 5.0 |
| A-7 | secondary aliphatic saturated alcohol (monohydric) | 103 | 5.0 |
| A-8 | primary aliphatic saturated alcohol (monohydric) | 25 | 5.0 |
| A-9 | primary aliphatic saturated alcohol (monohydric) | 24 | 5.0 |
| A-10 | — | — | — |
| A-11 | dodecenylsuccinic anhydride | 12 | 5.0 |
| A-12 | — | — | — |
| A-13 | — | — | — |

(*3) The amount of long-chain monomer addition is the mass % with reference to the total polyester-type resin.

TABLE 3

| crystalline polyester resin No. | alcohol component | mol parts | acid component | mol parts | peak temperature of the endothermic peak (° C.) | Mw | Mn |
|---|---|---|---|---|---|---|---|
| B-1 | 1,12-dodecanediol | 100.0 | sebacic acid | 100.0 | 84.1 | 9500 | 2985 |
| B-2 | 1,5-pentanediol<br>1,6-hexanediol | 40.0<br>60.0 | terephthalic acid | 95.0 | 94.8 | 10152 | 3125 |
| B-3 | 1,10-decanediol | 100.0 | suberic acid | 93.0 | 52.5 | 9200 | 2650 |
| B-4 | neopentyl glycol<br>1,6-hexanediol | 30.0<br>70.0 | terephthalic acid | 95.0 | 97.2 | 65000 | 4256 |
| B-5 | 1,9-nonanediol | 100.0 | 1,10-decane dicarboxylic acid | 100.0 | 73.2 | 25000 | 5800 |
| B-6 | 1,8-octanediol | 100.0 | suberic acid | 100.0 | 61.5 | 9600 | 2685 |

TABLE 4

| | toner No. | | | | | | | | | | | | | | |
|---|---|---|---|---|---|---|---|---|---|---|---|---|---|---|---|
| | T-1 | T-2 | T-3 | T-4 | T-5 | T-6 | T-7 | T-8 | T-9 | T-10 | T-11 | T-12 | T-13 | T-14 | T-15 |
| polyester-type resin 1 | A-1 | A-4 | A-4 | A-4 | A-2 | A-3 | A-5 | A-6 | A-8 | A-1 | A-10 | A-11 | A-12 | A-9 | A-7 |
| amount of addition (mass parts) | 60.0 | 100.0 | 100.0 | 100.0 | 60.0 | 60.0 | 100.0 | 100.0 | 100.0 | 60.0 | 100.0 | 100.0 | 100.0 | 100.0 | 100.0 |
| polyester-type resin 2 | A-13 | — | — | — | A-13 | A-13 | — | — | — | A-13 | — | — | | — | — |
| amount of addition (mass parts) | 40.0 | — | — | — | 40.0 | 40.0 | — | — | — | 40.0 | — | — | | — | |
| crystalline polyester resin | B-1 | B-1 | B-1 | B-1 | B-1 | B-1 | B-1 | B-2 | B-1 | B-1 | B-1 | B-1 | B-1 | B-3 | B-4 |
| amount of addition (mass parts) | 2.5 | 2.5 | 5.0 | 7.5 | 2.5 | 2.5 | 2.5 | 5.0 | 5.0 | 2.5 | 2.5 | 2.5 | 9.0 | 2.5 | 2.5 |

TABLE 5

| | | Example | | | | | | | | | |
|---|---|---|---|---|---|---|---|---|---|---|---|
| | | 1 | 2 | 3 | 4 | 5 | 6 | 7 | 8 | 9 | 10 |
| | | toner No. | | | | | | | | | |
| | | T-1 | T-2 | T-3 | T-4 | T-5 | T-6 | T-7 | T-8 | T-9 | T-10 |
| peak originating with the crystalline polyester resin | peak temperature of the endothermic peak in the total heat flow (° C.) | 76.7 | 75.3 | 76.5 | 76.7 | 75.6 | 76.6 | 75.3 | 94.3 | 76.3 | 75.6 |
| | endothermic quantity percentage in the reversing heat flow (%) | 23.4 | 25.6 | 22.5 | 20.5 | 23.7 | 21.2 | 29.2 | 26.5 | 22.1 | 26.5 |
| | endothermic quantity ΔH1 in the total heat flow (J/g) | 1.40 | 1.42 | 2.60 | 3.95 | 1.32 | 1.46 | 1.42 | 2.90 | 5.00 | 1.40 |
| storability, 55° C./3 days | | A | A | A | B | A | A | A | A | B | A |
| fixing performance before standing (upper row: rank) | normal temperature normal humidity | A<br>2.5% | A<br>2.6% | A<br>3.1% | A<br>2.8% | A<br>2.9% | A<br>3.3% | A<br>3.3% | A<br>3.5% | B<br>8.9% | A<br>3.6% |

TABLE 5-continued

| | | Example | | | | | | | | | |
|---|---|---|---|---|---|---|---|---|---|---|---|
| | | 1 | 2 | 3 | 4 | 5 | 6 | 7 | 8 | 9 | 10 |
| | | toner No. | | | | | | | | | |
| | | T-1 | T-2 | T-3 | T-4 | T-5 | T-6 | T-7 | T-8 | T-9 | T-10 |
| (lower row: value) | | | | | | | | | | | |
| fixing performance before standing (upper row: rank) (lower row: value) | low temperature low humidity | A 3.2% | A 3.1% | A 3.5% | A 3.3% | A 3.1% | A 3.2% | B 5.9% | A 3.7% | B 9.2% | A 4.2% |
| fixing performance after standing (upper row: rank) (lower row: value) | normal temperature normal humidity | A 2.9% | A 2.9% | A 3.3% | B 5.5% | A 3.3% | A 3.4% | A 3.9% | A 3.9% | B 9.1% | A 4.1% |
| ΔTg(° C.) | | 1.1 | 0.9 | 1.3 | 1.2 | 1.1 | 2.1 | 0.9 | 1.3 | 1.9 | 1.1 |
| results of the evaluation of the developing performance (high temperature, high humidity) (upper row: rank) (lower row: value) | | A 2.5% | A 2.3% | A 2.4% | B 3.5% | A 2.6% | A 2.3% | B 4.2% | A 2.3% | A 2.8% | A 2.7% |
| results of the evaluation of the developing performance (low temperature, low humidity) (upper row: rank) (lower row: value) | | A 2.1% | A 1.8% | A 2.1% | A 2.8% | A 2.4% | A 2.1% | A 2.1% | A 2.1% | A 2.6% | A 2.6% |

TABLE 6

| | | Comparative Example | | | | | | |
|---|---|---|---|---|---|---|---|---|
| | | 1 | 2 | 3 | 4 | 5 | 6 | 7 |
| | | toner No. | | | | | | |
| | | T-11 | T-12 | T-13 | T-14 | T-15 | T-16 | T-17 |
| peak originating with the crystalline polyester resin | peak temperature of the endothermic peak in the total heat flow (° C.) | 79.3 | 76.7 | 75.6 | 51.2 | 99.5 | 65.4 | 58.6 |
| | endothermic quantity percentage in the reversing heat flow (%) | 19.4 | 18.6 | 23.4 | 19.5 | 25.3 | 16.2 | 13.1 |
| | endothermic quantity ΔH1 in the total heat flow (J/g) | 0.74 | 0.90 | 7.52 | 1.60 | 1.50 | 4.06 | 12.04 |
| storability, 55° C./3 days | | A | A | C | D | A | C | C |
| fixing performance before standing (upper row: rank) (lower row: value) | normal temperature normal humidity | A 4.2% | A 4.5% | C 13.5% | A 3.9% | A 12.6% | C 4.4% | A 4.2% |
| fixing performance before standing (upper row: rank) (lower row: value) | low temperature low humidity | A 4.8% | A 4.6% | D 15.9% | A 4.3% | D 15.3% | A 4.8% | A 4.6% |
| fixing performance after standing (upper row: rank) (lower row: value) | normal temperature normal humidity | D 15.6% | D 15.3% | C 14.2% | D 15.9% | C 13.1% | D 15.4% | D 15.7% |

TABLE 6-continued

| | Comparative Example | | | | | | |
|---|---|---|---|---|---|---|---|
| | 1 | 2 | 3 | 4 | 5 | 6 | 7 |
| | toner No. | | | | | | |
| | T-11 | T-12 | T-13 | T-14 | T-15 | T-16 | T-17 |
| ΔTg(° C.) | 5.3 | 7.1 | 1.3 | 5.2 | 1.4 | 6.5 | 5.9 |
| results of the evaluation of the developing performance (high temperature, high humidity) (upper row: rank) (lower row: value) | A<br>2.3% | B<br>3.6% | C<br>6.3% | B<br>3.3% | B<br>2.8% | A<br>4.2% | B<br>5.3% |
| results of the evaluation of the developing performance (low temperature, low humidity) (upper row: rank) (lower row: value) | A<br>2.1% | A<br>2.8% | A<br>2.9% | A<br>2.6% | A<br>2.1% | A<br>2.9% | A<br>2.9% |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-160757, filed Aug. 1, 2013, which is hereby incorporated by reference herein in its entirety.

What is claimed is:

1. A toner comprising:

a toner particle that contains at least a resin component, the resin component containing;

a first resin as a major component, and a second resin, wherein;

the first resin is a polyester-type resin, the polyester-type resin has;

a terminal end at which an aliphatic compound has been condensed, and the aliphatic compound being selected from the group consisting of:

an aliphatic monocarboxylic acid having a peak value of the number of carbon atom in the range from 25 to 102, and an aliphatic monoalcohol having a peak value of the number of carbon atom in the range from 25 to 102, and the content of a long-chain aliphatic hydrocarbon group that originates with the aliphatic compound is from at least 0.1 mass % to not more than 20.0 mass % in the polyester-type resin, and wherein:

the second resin is a crystalline polyester resin, and in a total heat flow of the toner obtained by measuring the toner with a temperature-modulated differential scanning calorimeter, the toner has an endothermic peak resulting from the crystalline polyester resin in the temperature range from at least 50.0° C. to not more than 100.0° C., and the percentage of an endothermic quantity of the endothermic peak in a reversing heat flow with respect to an endothermic quantity of the endothermic peak in the total heat flow being at least 20.0%.

2. The toner according to claim 1, wherein the endothermic quantity of the endothermic peak in the total heat flow is from at least 0.10 J/g to less than 4.00 J/g.

3. The toner according to claim 1, wherein the polyester-type resin is a hybrid resin in which a polyester segment and a vinylic polymer segment are chemically bonded.

4. The toner according to claim 3, wherein the mass ratio between the polyester segment and the vinylic polymer segment in the hybrid resin is from 50:50 to 90:10.

5. The toner according to claim 1, wherein the toner particle is a toner particle obtained through at least a melt kneading step and a pulverization step.

6. The toner according to claim 1, wherein, the crystalline polyester resin has a peak temperature of an endothermic peak of from at least 50.0° C. to not more than 100.0° C., in the total heat flow measured by the temperature-modulated differential scanning calorimeter.

7. The toner according to claim 1, wherein the content of the long-chain aliphatic hydrocarbon group that originates with the aliphatic compound is from at least 1.0 mass % to not more than 15.0 mass % in the polyester-type resin.

8. The toner according to claim 1, wherein the content of the long-chain aliphatic hydrocarbon group that originates with the aliphatic compound is from at least 2.0 mass % to not more than 10.0 mass % in the polyester-type resin.

9. A toner comprising:

a toner particle that contains at least a resin component, the resin component containing;

a first resin as a major component, and a second resin, wherein;

the first resin is a polyester-type resin, the polyester-type resin has;

a terminal end at which an aliphatic compound has been condensed, and the aliphatic compound being selected from the group consisting of:

an aliphatic monocarboxylic acid having a peak value of the number of carbon atom in the range from 25 to 102, and an aliphatic monoalcohol having a peak value of the number of carbon atom in the range from 25 to 102, wherein the polyester-type resin is a hybrid resin in which a polyester segment and a vinylic polymer segment are chemically bonded, and wherein:

the second resin is a crystalline polyester resin, and in a total heat flow of the toner obtained by measuring the toner with a temperature-modulated differential scanning calorimeter, the toner has an endothermic peak resulting from the crystalline polyester resin in the temperature range from at least 50.0° C. to not more than 100.0° C., and the percentage of an endothermic quantity of the endothermic peak in a reversing heat flow with respect to an endothermic quantity of the endothermic peak in the total heat flow being at least 20.0%.

10. The toner according to claim 9, wherein the mass ratio between the polyester segment and the vinylic polymer segment in the hybrid resin is from 50:50 to 90:10.

* * * * *